US005930900A

United States Patent [19]

Chang

[11] Patent Number: 5,930,900

[45] Date of Patent: Aug. 3, 1999

[54] SCISSORS

[76] Inventor: Chia-Yin Chang, 9, Jiu Ju Street, Da Li, Taichung Hsien, Taiwan

[21] Appl. No.: 08/935,250

[22] Filed: Sep. 22, 1997

[51] Int. Cl.[6] ..... B26B 13/00; B25G 1/00; B25G 3/00

[52] U.S. Cl. ..... 30/262; 30/341; 30/344

[58] Field of Search ..... 30/262, 261, 257, 30/260, 341, 339, 236, 254, 255, 344, 342

[56] References Cited

U.S. PATENT DOCUMENTS

| | | | |
|---|---|---|---|
| 749,438 | 1/1904 | Harrington | 30/344 X |
| 1,456,339 | 5/1923 | Rauh | 30/262 |
| 1,700,306 | 1/1929 | Bernard | 30/262 X |
| 1,963,564 | 6/1934 | Smith et al. | 30/262 X |
| 2,655,722 | 10/1953 | Klenk | 30/262 X |
| 2,769,237 | 11/1956 | Oxhandler | 30/254 |
| 3,453,651 | 7/1969 | Wertepny | 30/344 X |
| 3,951,013 | 4/1976 | Laurenti | 30/254 X |
| 4,106,195 | 8/1978 | Berg | 30/260 X |
| 5,203,084 | 4/1993 | Kuo | 30/261 X |
| 5,243,762 | 9/1993 | Orthey | 30/262 X |
| 5,419,048 | 5/1995 | Horgan et al. | 30/254 X |

FOREIGN PATENT DOCUMENTS

| | | | |
|---|---|---|---|
| 2430296 | 3/1980 | France | 30/344 |
| 30788 | 3/1885 | Germany | 30/255 |
| 2100168 | 12/1982 | United Kingdom | 30/254 |

*Primary Examiner*—M. Rachuba
*Assistant Examiner*—John C. Wegand
*Attorney, Agent, or Firm*—Peterson, Wicks, Nemer & Kamrath, P.A.

[57] ABSTRACT

A pair of scissors has a first blade, a second blade, a first grip connected to the first blade, a second grip connected to the second blade, a torsion spring disposed between the first grip and the second grip, and a hook ring fastening the first grip and the second grip movably. The first grip has a first upper handle and a first lower handle coupled to the first upper handle. The second grip has a second upper handle and a second lower handle coupled to the second upper handle.

19 Claims, 5 Drawing Sheets

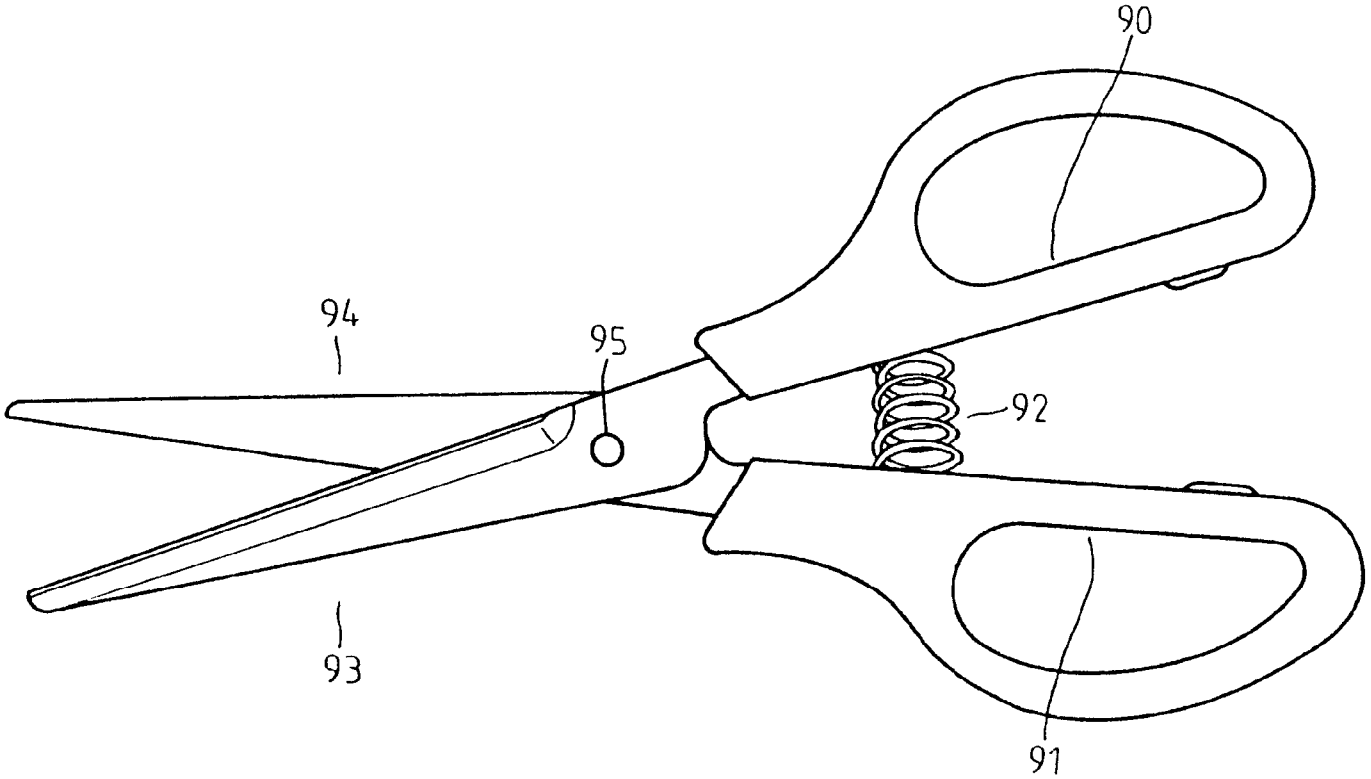
FIG • 1
PRIOR ART

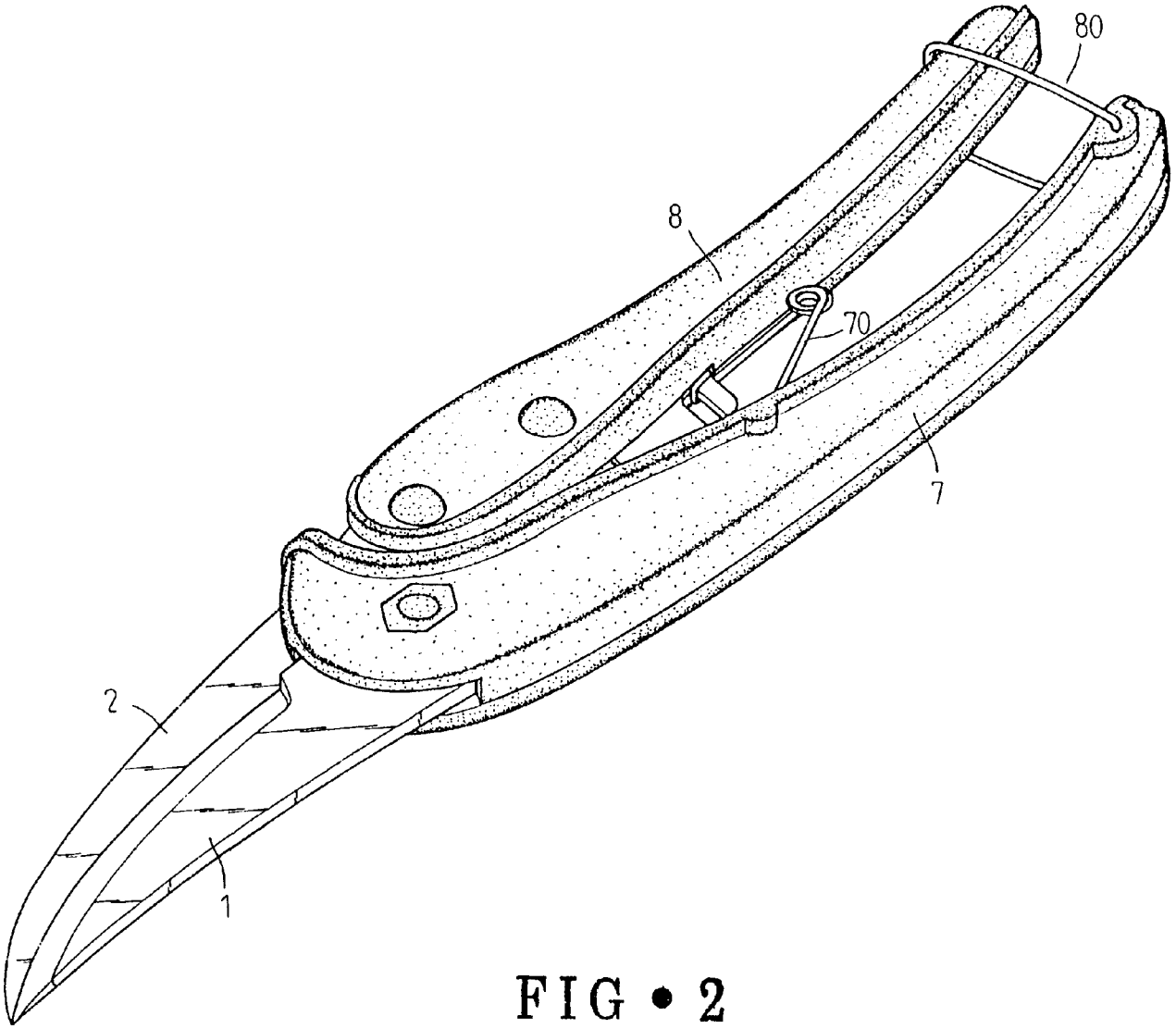
FIG • 2

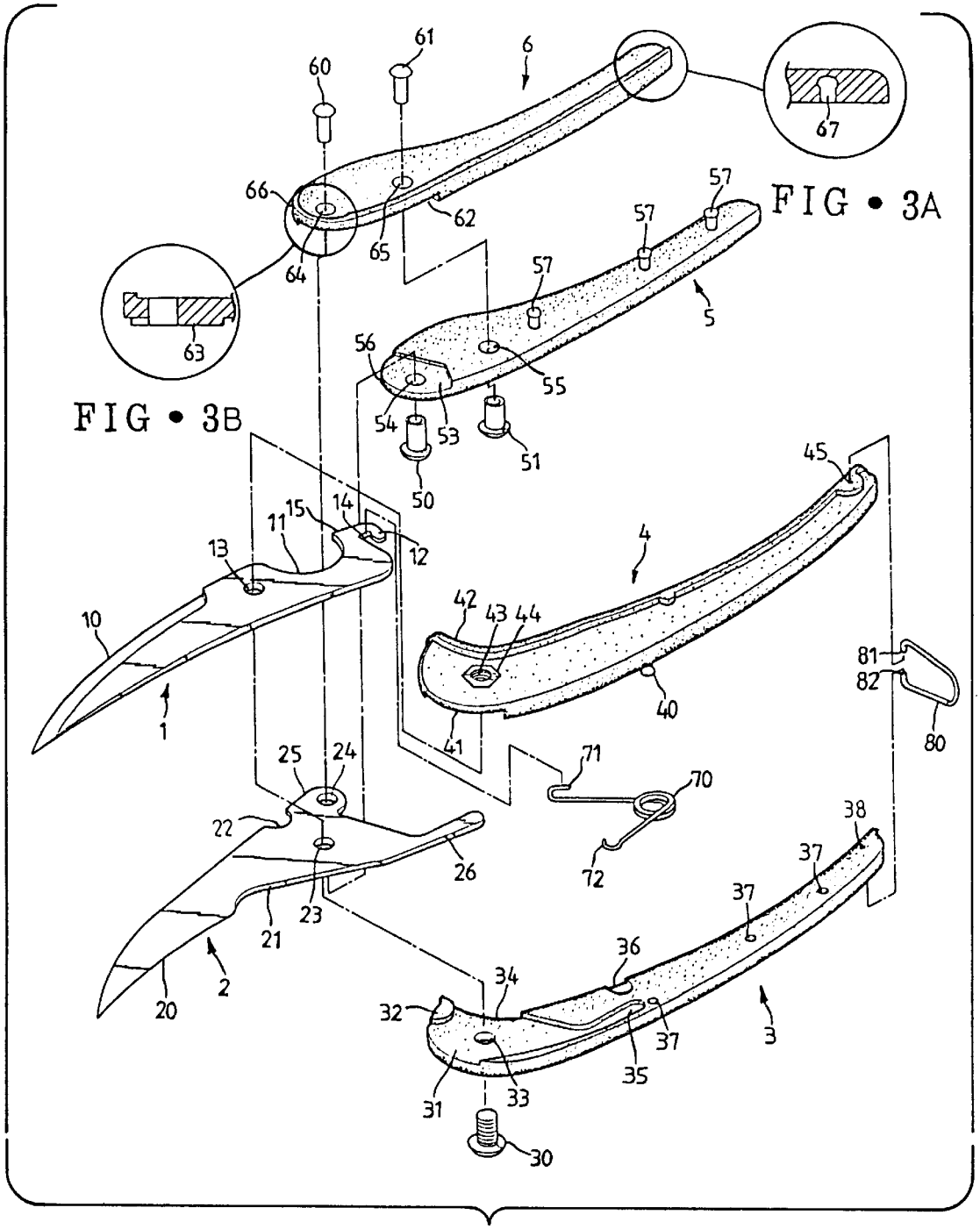
FIG • 3

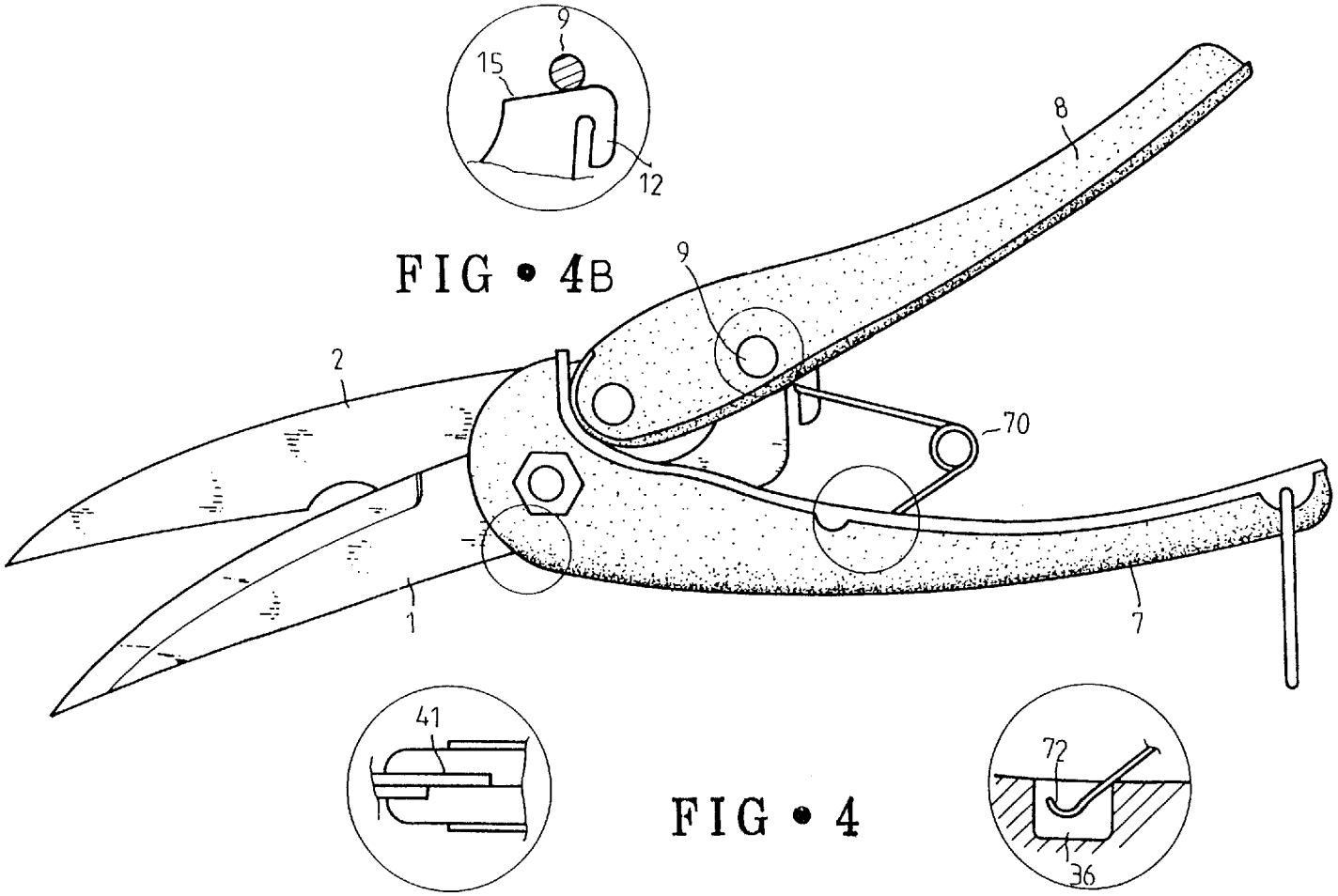
FIG • 4B
FIG • 4
FIG • 4A
FIG • 4C

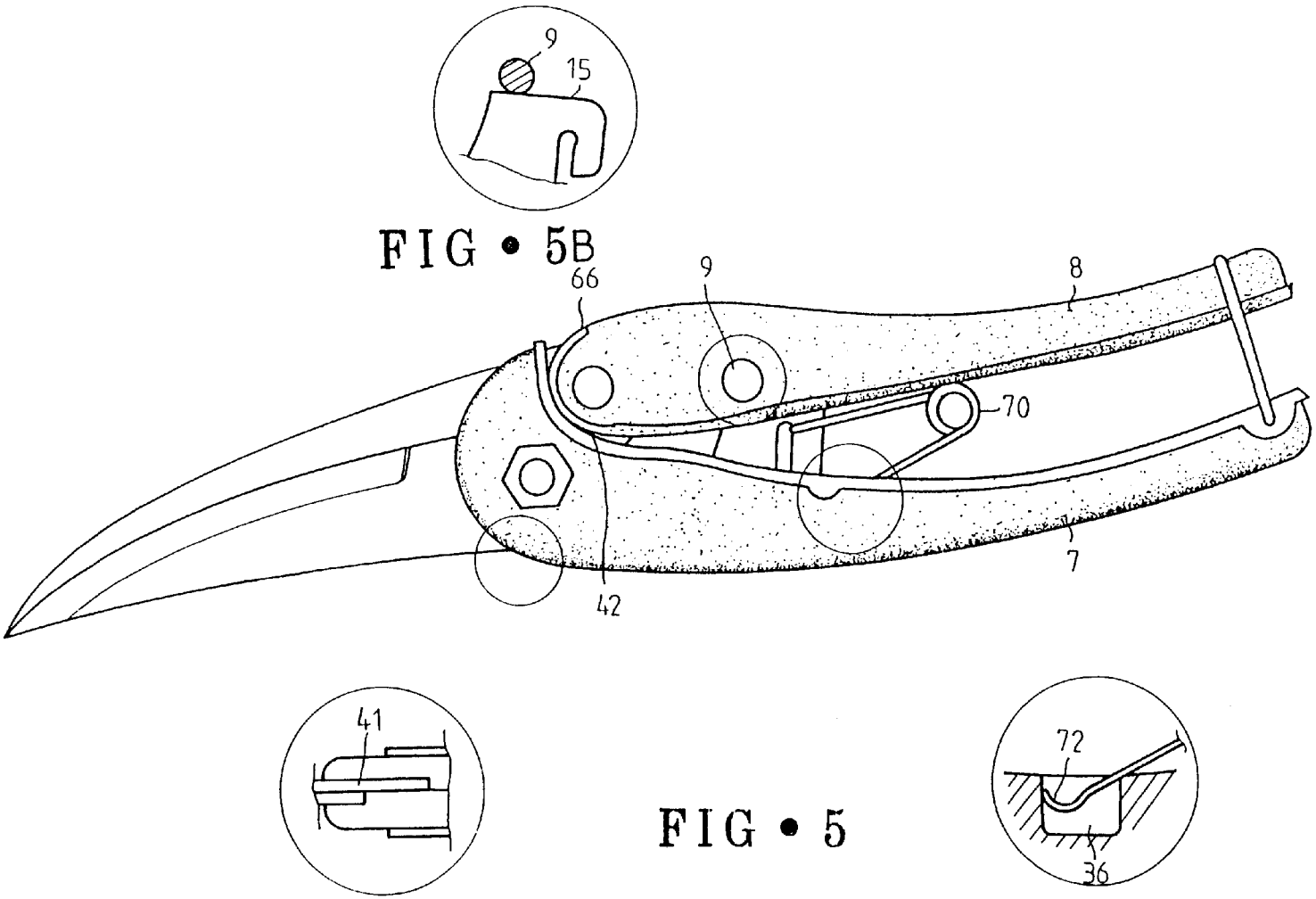
FIG • 5B
FIG • 5
FIG • 5A
FIG • 5C

SCISSORS

BACKGROUND OF THE INVENTION

The present invention relates to a pair of scissors. More particularly, the present invention relates to a pair of scissors which can cut a relatively hard article without damaging the pair of scissors.

Referring to FIG. 1, a pair of conventional scissors comprises a first blade 93, a second blade 94, a pivot 95 fastening the first blade 93 and the second blade 94 together, a first bow handle 90 connected to the first blade 93, a second bow handle 91 connected to the second blade 94, and a spring 92 disposed between the first bow handle 90 and the second bow handle 91. However, the spring 92 is often twisted or deformed after a long period of usage. Furthermore, the first blade 93 and the second blade 94 will be biased while cutting a relative hard article.

SUMMARY OF THE INVENTION

An object of the present invention is to provide a pair of scissors which can cut a relatively hard article without damaging the pair of scissors.

Another object of the present invention is to provide a pair of scissors which can cut a relatively hard article without biasing a first blade and a second blade.

Accordingly, a pair of scissors comprises a first blade, a second blade, a first grip connected to the first blade, a second grip connected to the second blade, a torsion spring disposed between the first grip and the second grip, and a hook ring fastening the first grip and the second grip movably. The first grip has a first upper handle and a first lower handle coupled to the first upper handle. The second grip has a second upper handle and a second lower handle coupled to the second upper handle. The first blade has a first edge, a notch portion, a rear block portion, a rear hook, a slot defined by the rear hook, and a first hole. The second blade has a second edge, a curved portion, a groove portion, a lug, a positioning hole defined by the lug, an extended end, and a second hole. The first upper handle has a first front end, a first front notch, a plurality of recess holes, a third hole, a front bottom cage portion, and a fourth hole. The first lower handle has a second front end, a first front recess, a fifth hole, a sixth hole, and a plurality of posts. The second upper handle has a second front notch, a first curved front portion, a terminal aperture, a threaded hole, a nut inserted in the threaded hole, and a plurality of pillars disposed on the second upper handle. The second lower handle has a front cage block, a second front recess, a cage recess communicating with the second front recess, a second curved front portion, a middle groove, a seventh hole, an end aperture, and a plurality of insertion holes. The extended end is inserted in the cage recess. The front cage block is inserted in the groove portion. A bolt passes through the seventh hole, the second hole, the first hole, and the threaded hole. The pillars are inserted in the insertion holes. The lug is inserted in the first front recess. The posts are inserted in the recess holes. The torsion spring has a first end inserted in the slot and a second end inserted in the middle groove. A first pin passes through the third hole, the positioning hole, and the fifth hole. A first rivet passes through the fifth hole, the positioning hole, and the third hole to engage with the first pin. A second pin passes through the fourth hole and the sixth hole. A second rivet passes through the sixth hole and the fourth hole to engage with the second pin.

BRIEF DESCRIPTION OF THE DRAWINGS

FIG. 1 is a perspective view of a pair of scissors of the prior art;

FIG. 2 is a perspective view of a pair of scissors of a preferred embodiment in accordance with the present invention while the pair of scissors is not in operation;

FIG. 3 is a perspective exploded view of a pair of scissors of a preferred embodiment in accordance with the present invention;

FIG. 3A is a sectional view of a rear end of a first upper handle in FIG. 3;

FIG. 3B is a sectional view of a front end of a first upper handle in FIG. 3;

FIG. 4 is a perspective view of a pair of scissors of a preferred embodiment in accordance with the present invention while the pair of scissors is in operation;

FIG. 4A is a partially sectional view illustrating a second end of a torsion spring inserted in a groove of a second lower handle in FIG. 4;

FIG. 4B is a partially sectional view illustrating a block portion of a first blade blocked by a cage column in FIG. 4;

FIG. 4C is a partially elevational view of a second notch of a second upper handle in FIG. 4;

FIG. 5 is an elevational view of FIG. 2;

FIG. 5A is a partially sectional view illustrating a second end of a torsion spring inserted in a groove of a second lower handle in FIG. 5;

FIG. 5B is a partially sectional view illustrating a block portion of a first blade blocked by a cage column in FIG. 5; and FIG. 5C is a partially elevational view of a second notch of a second upper handle in FIG. 5.

DETAILED DESCRIPTION OF THE INVENTION

Referring to FIGS. 2 to 5C, a pair of scissors comprises a first blade 1, a second blade 2, a first grip 8 connected to the first blade 1, a second grip 7 connected to the second blade 2, a torsion spring 70 disposed between the first grip 8 and the second grip 7, and a hook ring 80 fastening the first grip 8 and the second grip 7 movably. The first grip 8 has a first upper handle 6 and a first lower handle 5 coupled to the first upper handle 6. The second grip 7 has a second upper handle 4 and a second lower handle 3 coupled to the second upper handle 4.

The first blade 1 has a first edge 10, a notch portion 11, a rear block portion 15, a rear hook 12, a slot 14 defined by the rear hook 12, and a first hole 13.

The second blade 2 has a second edge 20, a curved portion 21, a groove portion 22, a lug 25, a positioning hole 24 defined by the lug 25, an extended end 26, and a second hole 23.

The first upper handle 6 has a first front end 66, a first front notch 62, a plurality of recess holes 67, a third hole 64, a front bottom cage portion 63, and a fourth hole 65.

The first lower handle 5 has a second front end 56, a first front recess 53, a fifth hole 54, a sixth hole 55, and a plurality of posts 57.

The second upper handle 4 has a second front notch 41, a first curved front portion 42, a terminal aperture 45, a threaded hole 43, a nut 44 inserted in the threaded hole 43, and a plurality of pillars 40 disposed on the second upper handle 4.

The second lower handle 3 has a front cage block 32, a second front recess 31, a cage recess 35 communicating with the second front recess 31, a second curved front portion 34, a middle groove 36, a seventh hole 33, an end aperture 38, and a plurality of insertion holes 37.

The extended end 26 is inserted in the cage recess 35. The front cage block 32 is inserted in the groove portion 22. A bolt 30 passes through the seventh hole 33, the second hole 23, the first hole 13, and the threaded hole 43. The pillars 40 are inserted in the insertion holes 37. The lug 25 is inserted in the first front recess 53. The posts 57 are inserted in the recess holes 67. The torsion spring 70 has a first end 71 inserted in the slot 14 and a second end 72 inserted in the middle groove 36.

A first pin 60 passes through the third hole 64, the positioning hole 24, and the fifth hole 54. A first rivet 50 passes through the fifth hole 54, the positioning hole 24, and the third hole 64 to engage with the first pin 60. A second pin 61 passes through the fourth hole 65 and the sixth hole 55. A second rivet 51 passes through the sixth hole 55 and the fourth hole 65 to engage with the second pin 61. The second pin 61 and the second rivet 51 become a cage column 9.

The hook ring 80 has a first hook end 81 inserted in the terminal aperture 45 and a second hook end 82 inserted in the end aperture 38.

Referring to FIGS. 4 to 4C, the first end 71 of the torsion spring 70 pushes the rear hook 12 toward the cage column 9.

Referring to FIGS. 5 to 5C, the first grip 8 moves toward the second grip 7. The bolt 30 functions as a pivot point between the first blade 1 and the second blade 2. The hook ring 80 surrounds a rear end of the first grip 8.

The invention is not limited to the above embodiment but various modification thereof may be made. Further, various changes in form and detail may be made without departing from the scope of the invention.

I claim:

1. A pair of scissors comprising, in combination:

a first blade, a second blade, a first grip connected to the first blade, a second grip connected to the second blade, the first grip having a first upper handle and a first lower handle coupled to the first upper handle, the second grip having a second upper handle and a second lower handle coupled to the second upper handle, the first blade having a first edge, a notch portion, a rear block portion, and a first hole, the second blade having a second edge, a curved portion, a positioning hole, an extended end, and a second hole, the first upper handle having a first front end, a first front notch, a third hole, a front bottom cage portion, and a fourth hole, the first lower handle having a second front end, a first front recess, a fifth hole, and a sixth hole, the second upper handle having a second front notch, a first curved front portion, and a threaded hole, the second lower handle having a second front recess, a cage recess communicating with the second front recess, a second curved front portion, and a seventh hole, the extended end of said second blade is inserted in the cage recess, a bolt passing through the seventh hole, the second hole, the first hole, and the threaded hole, a first pin passing through the third hole, the positioning hole, and the fifth hole, and a first rivet passing through the fifth hole, the positioning hole, and the third hole to engage with the first pin;

said scissors further comprising of a torsion spring disposed between the first grip and the second grip, with the first blade having a rear hook defining a slotted region, with the second lower handle having a middle groove with the torsion spring having a first end inserted in the slotted region and a second end inserted in the middle groove.

2. A pair of scissors as claimed in claim 1, wherein the second upper handle has a terminal aperture, with the second lower handle having an end aperture; and wherein the pair of scissors further comprises, in combination: a hook ring having a first hook end inserted in the terminal aperture and a second hook end inserted in the end aperture.

3. A pair of scissors as claimed in claim 1, further comprising, in combination: a plurality of pillars disposed on the second upper handle; and wherein the first upper handle has a plurality of recess holes, with the first lower handle having a plurality of posts, with the posts being inserted in the recess holes, with the second lower handle including a plurality of insertion holes, with the pillars being inserted in the insertion holes.

4. A pair of scissors as claimed in claim 3, further comprising, in combination: a second pin passing through the fourth hole and the sixth hole, and a second rivet passing through the sixth hole and the fourth hole to engage with the second pin.

5. A pair of scissors as claimed in claim 4, wherein the second lower handle has a front cage block, with the second blade having a groove portion, with the front cage block inserted in the groove portion.

6. A pair of scissors as claimed in claim 5, further comprising, in combination: a nut inserted in the threaded hole.

7. A pair of scissors as claimed in claim 6, wherein the second blade has a lug, with the positioning hole being defined by the lug, with the lug being inserted in the first front recess.

8. A pair of scissors as claimed in claim 7, wherein the second upper handle has a terminal aperture, with the second lower handle having an end aperture; and wherein the pair of scissors further comprises, in combination: a hook ring having a first hook end inserted in the terminal aperture and a second hook end inserted in the end aperture.

9. A pair of scissors as claimed in claim 1, further comprising, in combination: a second pin passing through the fourth hole and the sixth hole, and a second rivet passing through the sixth hole and the fourth hole to engage with the second pin.

10. A pair of scissors as claimed in claim 9, wherein the second lower handle has a front cage block, with the second blade having a groove portion, with the front cage block inserted in the groove portion.

11. A pair of scissors as claimed in claim 10, further comprising, in combination: a nut inserted in the threaded hole.

12. A pair of scissors as claimed in claim 11, wherein the second blade has a lug, with the positioning hole being defined by the lug, with the lug being inserted in the first front recess.

13. A pair of scissors as claimed in claim 12, wherein the second upper handle has a terminal aperture, with the second lower handle having an end aperture; and wherein the pair of scissors further comprises, in combination: a hook ring having a first hook end inserted in the terminal aperture and a second hook end inserted in the end aperture.

14. A pair of scissors as claimed in claim 1, wherein the second lower handle has a front cage block, with the second blade having a groove portion, with the front cage block inserted in the groove portion.

15. A pair of scissors as claimed in claim 14, further comprising, in combination: a nut inserted in the threaded hole.

16. A pair of scissors as claimed in claim 15, wherein the second blade has a lug, with the positioning hole being defined by the lug, with the lug being inserted in the first front recess.

17. A pair of scissors as claimed in claim 16, wherein the second upper handle has a terminal aperture, with the second lower handle having an end aperture; and wherein the pair of scissors further comprises, in combination: a hook ring having a first hook end inserted in the terminal aperture and a second hook end inserted in the end aperture.

18. A pair of scissors as claimed in claim 1, further comprising, in combination: a nut inserted in the threaded hole.

19. A pair of scissors as claimed in claim 1, wherein the second blade has a lug, with the positioning hole being defined by the lug, with the lug being inserted in the first front recess.

* * * * *